United States Patent [19]

Schacht et al.

[11] Patent Number: 4,800,128

[45] Date of Patent: Jan. 24, 1989

[54] CHEMICAL ATTACK-RESISTANT, LIQUID-TIGHT LINING

[75] Inventors: Eckhard Schacht, Montabaur; Dieter Velte, Ransbach-Baumbach; Wolfgang Werner, Montabaur-Horressen; Albert Wolf, Heiligenroth, all of Fed. Rep. of Germany

[73] Assignee: Keramchemie GmbH, Siershahn, Fed. Rep. of Germany

[21] Appl. No.: 58,044

[22] Filed: Jun. 4, 1987

[30] Foreign Application Priority Data

Jun. 23, 1986 [DE] Fed. Rep. of Germany ..... 3620976

[51] Int. Cl.[4] ..... B32B 9/04; B65D 90/04; E04B 5/48

[52] U.S. Cl. ..... 421/448; 428/446; 428/450; 174/48; 174/96; 220/1 B; 220/3; 220/5 A; 220/453; 52/169.11; 52/169.14; 52/169.7; 52/173 R; 52/221; 52/268

[58] Field of Search ..... 428/156, 209, 411.1, 428/446, 448, 450; 174/48, 96, 97, 98; 220/1 B, 3, 5 A, 453; 52/169.11, 169.14, 169.7, 173, 221, 268

[56] References Cited

U.S. PATENT DOCUMENTS

| | | | |
|---|---|---|---|
| 4,352,601 | 10/1982 | Valiga et al. | 52/169.7 |
| 4,584,802 | 4/1986 | Casselman et al. | 220/1 B |
| 4,651,893 | 3/1987 | Mooney | 220/453 |

FOREIGN PATENT DOCUMENTS

| | | | |
|---|---|---|---|
| 0220730 | 5/1987 | European Pat. Off. | 220/1 B |
| 3235185 | 3/1984 | Fed. Rep. of Germany | 220/1 B |
| 3441412 | 5/1986 | Fed. Rep. of Germany | 52/180 |
| 0029613 | 3/1977 | Japan | 220/1 B |

*Primary Examiner*—George F. Lesmes
*Assistant Examiner*—P. J. Ryan
*Attorney, Agent, or Firm*—Toren, McGeady & Associates

[57] ABSTRACT

A liquid-tight lining which is resistant to chemical attack for catch reservoirs, containers or the like of concrete. The lining includes a continuous liquid-tight impervious layer provided above the surface of the concrete. To make possible a simple and safe and repeatable testing of the tightness of the lining, a porous intermediate layer is provided between the concrete and the impervious layer. At least one sensor cable having at least two conductors is placed in the intermediate layer in such a pattern that any location of the intermediate layer is not more than a certain maximum distance away from the cable. The sensor cable is connectible to an electrical monitoring unit.

8 Claims, 1 Drawing Sheet

CHEMICAL ATTACK-RESISTANT, LIQUID-TIGHT LINING

BACKGROUND OF THE INVENTION

1. Field of the Invention

The present invention relates to a liquid-tight lining which is resistant to chemical attack. The lining is used for catch reservoirs, containers or the like of concrete. The lining includes a continuous liquid-tight impervious layer which is placed on the top surface of the concrete.

2. Description of the Prior Art

Statutory requirements make it necessary for the authorities overseeing the construction of plants for storing, racking and loading materials which are dangerous to the ground water to determine whether these plants are suitable for use for these purposes. If sealing agents of plastics material or rubber are used, the authorities overseeing structural engineering projects must approve these materials. In practice, the requirements described above had had the consequence that coatings used for catch basins, catch reservoirs and containers of concrete are either of synthetic resins or sheeting of rubber or thermoplastic material.

The materials used for the above-described purposes must have resistance to chemical attack, resistance to the influence of weather, resistance to bacteria and the attack of rodents, and it must be possible to use these materials for covering cracks. The imperviousness of catch basins, catch reservoirs and containers must be tested during the construction thereof. Moreover, it must be possible to repeat these imperviousness tests without difficulties in regular or irregular intervals.

Experience in the field of constructing structures which are protected against acid attack has shown that coatings of synthetic resins and linings of sheetings of rubber or thermoplastic material are not sufficiently resistant to mechanical stress, such as, stress occurring when trucks or stackers travel thereon. It is for this reason that in structures which must be resistant to acid, additional ceramic plates are placed on the coatings of synthetic resins or the sheetings of rubber or thermoplastic material. In many cases, the resistance to chemical attack can be obtained only when the coating or sheeting is combined with such a layer of plates. However, such an additional layer of plates make it impossible to repeat the imperviousness tests in the regions of the coatings or sheetings. This is because such tests would make it necessary to remove the plates, which would mean that the coating or sheeting would be destroyed.

It is, therefore, the primary object of the present invention to provide a liquid-tight lining which is resistant to chemical attack for catch reservoirs, containers or the like of concrete, wherein the imperviousness of the lining can be repeatedly tested in a simple and safe manner.

SUMMARY OF THE INVENTION

In accordance with the present invention, a porous intermediate layer is provided between the concrete layer and the impervious layer. At least one sensor cable having at least two conductors is provided in the intermediate layer. The sensor cable is laid in the intermediate layer in a pattern in such a way that the distance of any point of the intermediate layer from the sensor cable does not exceed a certain maximum. The sensor cable is connectible to an electrical monitoring unit.

Depending upon the type of liquid contained in the structure to be tested, the monitoring unit to which the sensor cable is connectible continuously monitors either the electrical resistance of the sensor cable or the impedance of the sensor cable and generates an alarm signal when liquid penetrates through the impervious layer and acts on the sensor cable. It is the purpose of the porous intermediate layer to conduct the liquid penetrating through the impervious layer to the closest portion of the sensor cable. The intermediate layer must also have sufficient strength for absorbing the mechanical loads to be expected.

The sensor cable may be embedded in the intermediate layer or it may be placed in grooves formed in the upper surface of the intermediate layer.

The material of the intermediate layer may be cement or plaster.

In addition to the impervious layer on top of the concrete, an impervious layer may be provided underneath the intermediate layer. At least one of the two impervious layers may be a foil. Also, at least one of the two impervious layers may be an electrically conducting synthetic resin.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter in which there are illustrated and described preferred embodiments of the invention.

DETAILED DESCRIPTION OF THE INVENTION

Figure 1:
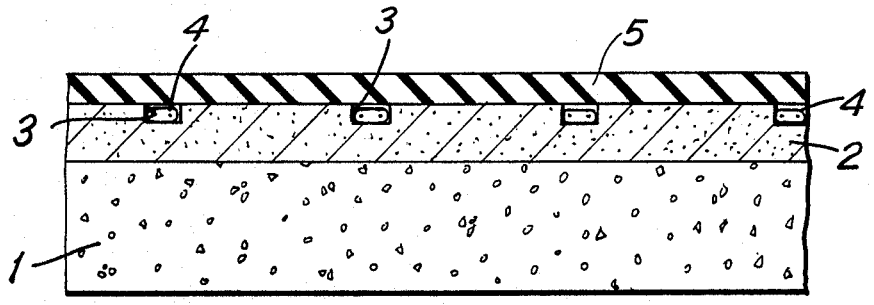
FIG. 1 is a sectional view of a portion of the lining according to the present invention.

FIG. 1 of the drawing shows a portion of a slab 1 of concrete which may form, for example, the bottom wall of a catch basin, not shown. A porous intermediate layer 2 of cement or plaster is placed on slab 1. This porous intermediate layer 2 has a limited capability to absorb liquids.

Grooves 3 are formed in the upper surface of the intermediate layer 2. These grooves 3 may be made in intermediate layer 2 either when the intermediate layer 2 is manufactured or the grooves may be prepared in a later work step. The grooves 3 may be arranged in the intermediate layer 2 either in a meandering or spiral pattern. The spacing between grooves is such that any point on slab 1 over the entire surface thereof is not more than a certain maximum distance away from a sensor cable 4 which is placed in grooves 3.

An impervious layer 5, for example, a rubber sheeting, may be placed on intermediate layer 2. If the impervious layer 5 is defective, any liquid penetrating through impervious layer 5 is conducted through porous intermediate layer 2 toward the nearest portion of sensor cable 4.

In the simplest case, sensor cables 4 are tapes with two conductors, wherein the resistance of the cable changes under the influence of water or another electrically conducting liquid. If the sensor cable 4 has a plurality of conductors, it is possible to further localize the location of any leak by means of appropriate additional electrical circuits. In the case of liquids which are not electrically conductive, sensor cables 4 are used whose impedance changes under the influence of organic materials, such as, solvents.

The spacing between sensor cables 4 is essentially selected in accordance with the speed with which the liquid travels within the porous intermediate layer 2 and the desired response time of an electrical monitoring unit, not shown.

Figure 2:
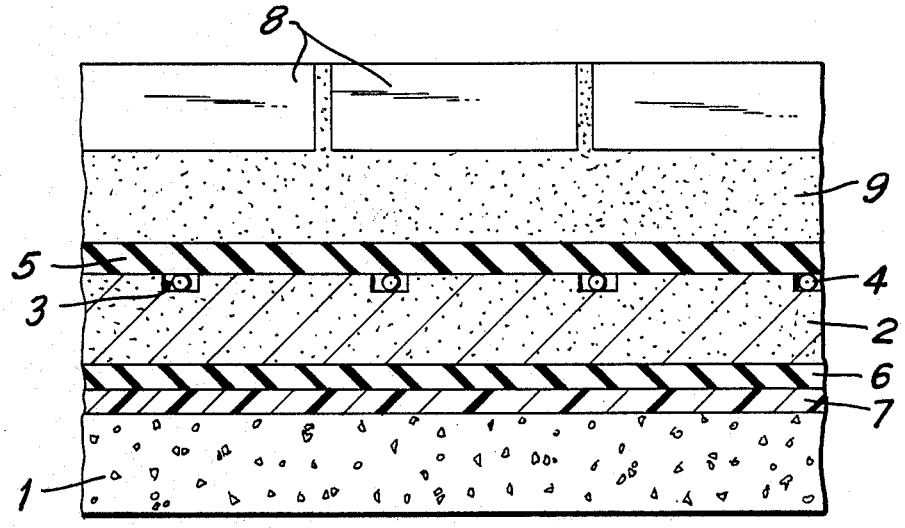
FIG. 2 is a sectional view of another embodiment of the lining according to the invention.

In the embodiment of the present invention illustrated in FIG. 2, another impervious layer 6 is provided under the porous intermediate layer 2, i.e. between intermediate layer 2 and concrete slab 1. The additional impervious layer 6 may be sheeting of rubber or thermoplastic material. The individual sheets of the impervious layer 6 are connected to each other in a sealing manner. Such an additional layer 6 is provided if moisture can be expected from the ground below. Thus, impervious layer 6 prevents false alarms from being generated by the monitoring unit in the case of rising liquids, for example, ground water. In addition, impervious layer 6 limits the damage in the event that already a large amount of liquid has penetrated into intermediate layer 2 through impervious layer 5.

The thickness volume of intermediate layer 2 between the two impervious layers 5, 6 results in a lining which ensures a quick generation of an appropriate alarm and, on the other hand, provides sufficient time for initiating countermeasures. In addition, an electrically conducting layer 7 of synthetic resin may be provided underneath impervious layer 6. Layer 7 may be of, for example, epoxy resin. After the impervious layer 6 has been manufactured, layer 7 is used for checking the pores of impervious layer 6.

As can be further seen in FIG. 2, a layer of ceramic plates 8 is placed on top of impervious layer 5. Plates 8 are laid in a layer 9 of mastic or cement mortar.

Sensor cable 4 may be placed in intermediate layer 2 in the form of several measuring loops. Thus, particularly endangered areas of slab 1, for example, at ducts or expansion joints, can be monitored by a separate sensor cable 4 or a separate measuring loop.

While specific embkodiments of the invention have been shown and described in detail to illustrate the application of the inventive principles, it will be understood that the invention may be embodied otherwise without departing from such principles.

We claim:

1. A chemical attack-resistant, liquid-tight lining for catch basins, catch reservoirs or similar containers of concrete, comprising a continuous liquid-tight impervious layer of rubber or plastic material located above the surface of concrete, the improvement which comprises a porous intermediate layer of cement or plaster between the concrete and the impervious layer, and at least one sensor cable having at least two conductors placed in the intermediate layer, the cable being placed in the intermediate layer in such a pattern that any location of the intermediate layer is not more than a preselected maximum distance away from the cable, the cable being adapted for connection with an electrical monitoring unit.

2. The lining according to claim 1, wherein the sensor cable is embedded in the intermediate layer.

3. The lining according to claim 1, wherein the upper surface of the intermediate layer defines grooves, the sensor cable being placed in the grooves.

4. The lining according to claim 1, comprising an additional impervious layer of rubber or plastics material underneath the intermediate layer.

5. The lining according to claim 4, wherein at least one of the impervious layers is a foil.

6. The lining according to claim 4, wherein at least one of the impervious layers is of an electrically conducting synthetic resin.

7. The lining according to claim 1, comprising a layer of plates placed above the impervious layer.

8. The lining according to claim 4, comprising an electrically conducting layer of synthetic resin under the another impervious layer.

* * * * *